US005583325A

United States Patent [19]

Schutte et al.

[11] Patent Number: 5,583,325

[45] Date of Patent: Dec. 10, 1996

[54] MUFFLER WITH INTEGRAL CHECK VALVE

[75] Inventors: Peter T. Schutte, Syracuse; David M. Ebbing, Clarence Center; Frederick L. Miller, Jr., Syracuse, all of N.Y.

[73] Assignee: Carrier Corporation, Syracuse, N.Y.

[21] Appl. No.: 430,941

[22] Filed: Apr. 26, 1995

[51] Int. Cl.[6] ..... F01N 1/10

[52] U.S. Cl. ..... 181/237; 181/255; 181/272; 417/312

[58] Field of Search ..... 181/229, 237, 181/255, 257, 269, 272, 275, 277, 403; 417/312; 418/55.1

[56] References Cited

U.S. PATENT DOCUMENTS

| | | | |
|---|---|---|---|
| 3,620,330 | 11/1971 | Hall | 181/237 |
| 5,208,429 | 5/1993 | Field | 181/229 |
| 5,457,290 | 10/1995 | Sase et al. | 181/272 X |

*Primary Examiner*—Khanh Dang

[57] ABSTRACT

An unbiased valve is located within a muffler. The valve is positioned by the pressure differential across the valve and is either in the full open or full closed position. A pressure equalization tube is provided between the downstream cavity of the muffler and the back of the valve such that flow pattern produced low pressure areas are avoided and the valve can react to actual pressure differentials in the flow.

4 Claims, 2 Drawing Sheets

MUFFLER WITH INTEGRAL CHECK VALVE

BACKGROUND OF THE INVENTION

Positive displacement compressors have a pulsed output as trapped volumes are delivered to discharge. Mufflers are normally provided to reduce the noise generated as a result of the gas pulsations. When the compressor is initially shut off, there is a pressure differential across the compressor that tends to equalize through the compressor rather than through the refrigeration or air conditioning system. To prevent the reverse operation of the compressor as an expander without load, a check valve is normally provided in the compressor discharge to prevent reverse flow and operation. It is often a problem locating the check valve in an appropriate location and, if the valve is biased closed, it may move responsive to the pulsed output and thereby contribute further noise.

SUMMARY OF THE INVENTION

A flow responsive, unbiased valve is provided in the muffler and coacts with the inlet to the muffler to block return flow from the muffler to the compressor upon the occurrence of a condition tending to produce reverse flow such as shutting off the compressor.

It is an object of this invention to prevent reverse flow of compressed gas within the confines of a discharge gas pulsation muffler.

It is another object of this invention to prevent backflow of compressed gas through a compressor. These objects, and others as will become apparent hereinafter, are accomplished by the present invention.

Basically, a valve is provided which is located in a muffler and positioned responsive to flow without a return bias. The valve provides a smooth profile in the opening direction and a flow resisting profile in the closing direction.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
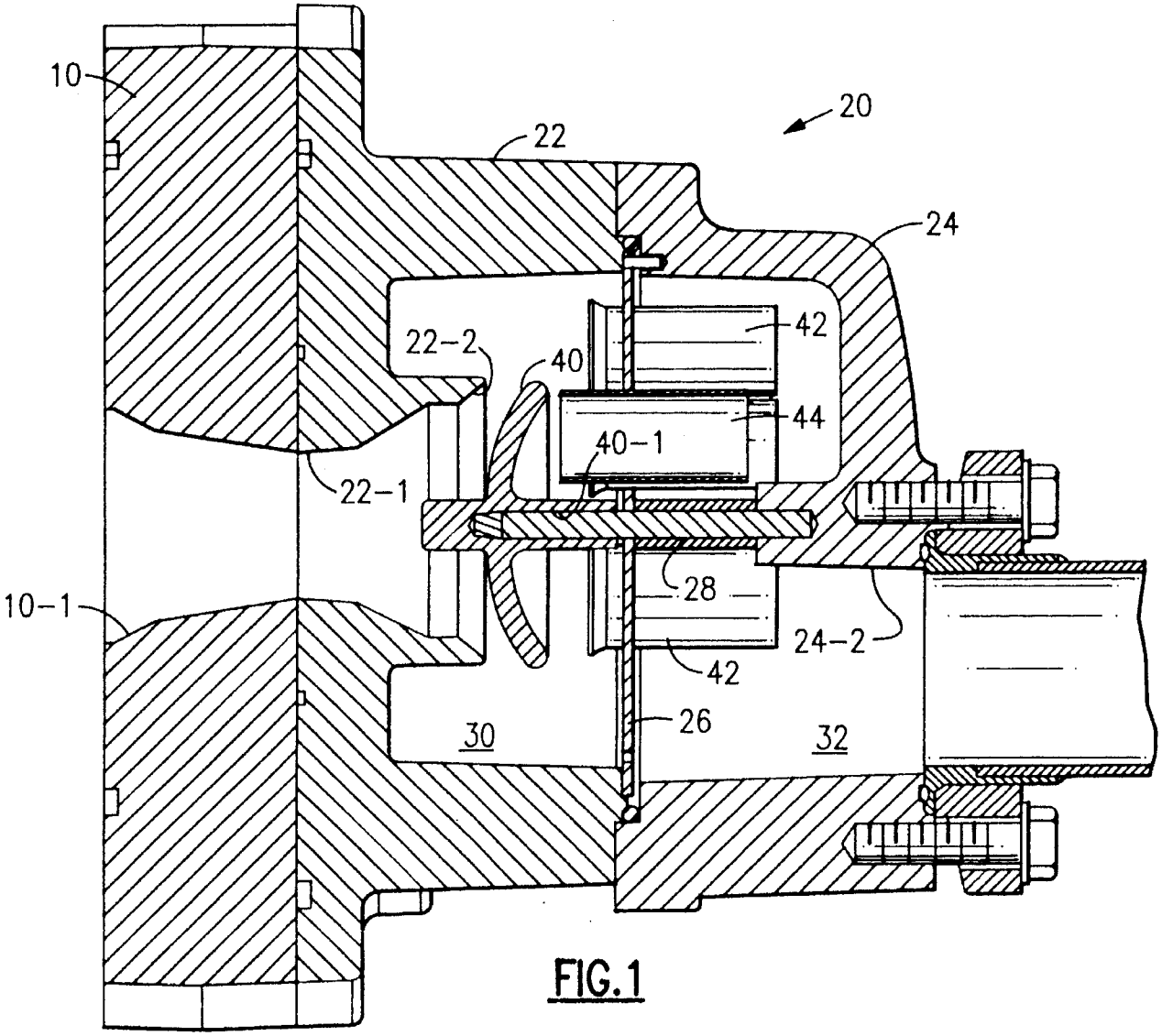
FIG. 1 is a sectional view of the check valve and muffler of the present invention with the valve in the open position.

In FIG. 1, the numeral 20 generally designates a muffler with an internal check valve which is sealingly connected to the discharge of a screw compressor 10. Muffler and check valve 20 includes a housing made up of a first portion 22 and a second portion 24 which are sealed together with partition or baffle plate 26 secured therebetween and defining an inlet cavity 30 with first portion 22 and a outlet cavity 32 with second portion 24. Portion 22 is secured to compressor 10 and has an inlet passage 22-1 connected to discharge passage 10-1 of compressor 10. Inlet passage 22-1 terminates in valve seat 22-2.

Figure 3:
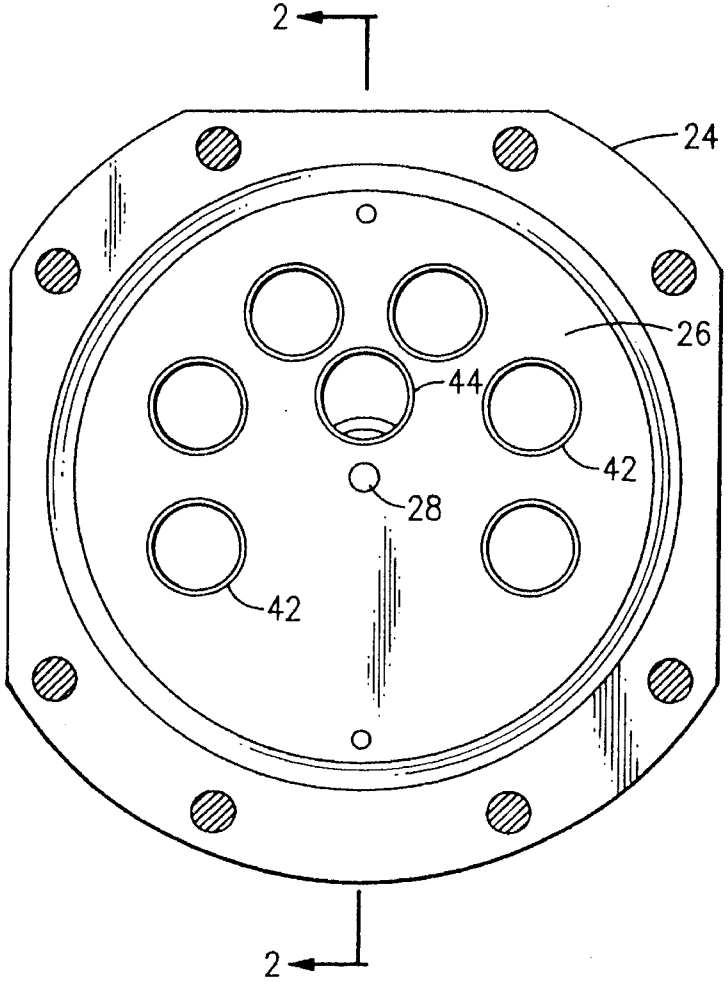
FIG. 3 is an end view of the muffler portion of FIG. 2.
Figure 2:
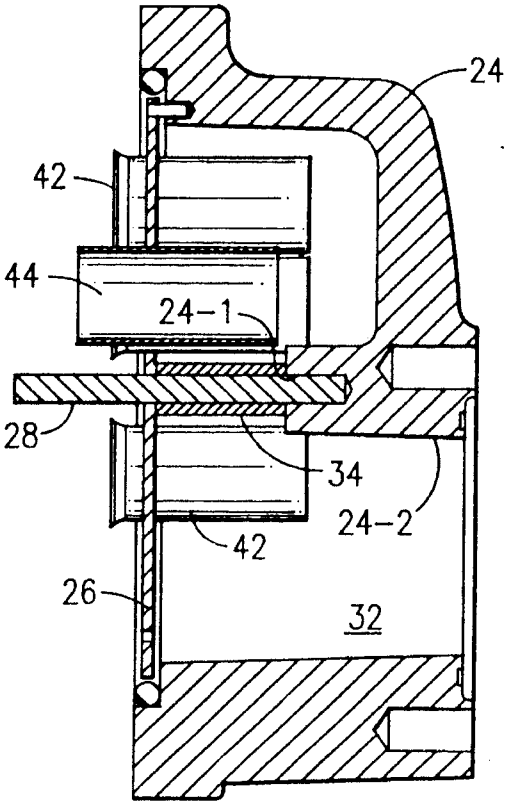
FIG. 2 is a sectional view of the muffler portion of FIG. 1.

As best shown in FIG. 2, valve guide stem 28 is fixedly received in bore 24-1, surrounded by spacer 34, and extends through partition 26 into cavity 30. Referring back to FIG. 1, valve guide stem 28 extends into bore 40-1 of valve 40. A plurality of muffler tubes 42 are secured in partition or baffle plate 26 and provide a fluid path between inlet cavity 30 and outlet cavity 32. As best shown in FIG. 3, muffler tubes 42 are arranged in an arcuate pattern over a portion of a circle such that none of the muffler tubes 42 is directly aligned with outlet 24-2 and are only tokenly overlain by valve 40. Muffler tubes 42 are identical and have the same radial spacing. Pressure equalization tube 44 is located radially inward of muffler tubes 42 so as to be completely overlain by valve 40 while not being directly aligned with outlet 24-2.

In operation valve 40 is slideable on valve guide stem 28 responsive to flow/pressure differential across valve 40. As illustrated in FIG. 1, valve 40 is in the fully open position and hot pressurized gas compressed in the compressor 10 serially flows through discharge passage 10-1, inlet passage 22-1 and over valve 40 into inlet cavity 30. Valve 40 overlies one end of pressure equalization tube 44 so that flow from inlet cavity 30 to outlet cavity 32 is via muffler tubes 42. Because muffler tubes 42 are not aligned with outlet 24-2, there is a reverberation in the flow in cavity 32 before the flow passes through outlet 24-2 to the refrigeration or air conditioning system. Pressure equalization tube 44 communicates the lower/downstream pressure of chamber 32 to the back side of valve 40 so there is no tendency for closing valve 40. In contrast, pressure pulsations produce chatter when conventional valves react to the changing pressure differential and start moving towards closing and back towards opening.

If the compressor 10 is shut off, the refrigeration or air conditioning system will tend to equalize through compressor 10. Flow will go from cavity 32, through muffler tubes 42 into cavity 30, over valve 40 and into passage 22-1 and back into compressor 10 via passage 10-1. But for the presence of pressure equalization tube 44, flow over valve 40 would produce a low pressure area behind valve 40 such that it would tend to remain open under reverse flow. Pressure equalization tube 44 communicates the cavity 32 pressure with the area behind valve 40 and the resultant pressure differential across valve 40 causes valve 40 to close upon conditions of reverse flow.

Although a preferred embodiment of the present invention has been illustrated and described, other modifications will occur to those skilled in the art. It is therefore intended that the present invention is to be limited only by the scope of the appended claims.

What is claimed is:

1. A muffler comprising:

a housing;

a partition dividing said housing into a first and second cavity;

an inlet communicating with said first cavity and an outlet communicating with said second cavity;

a valve seat forming a portion of said inlet;

muffler tubes supported by said partition and providing fluid communication between said first and second cavities; and a valve having a first side facing and adapted to seat on said valve seat, a second side facing said partition with said valve being movable between a first position seated on said valve seat and a second position permitting flow through said muffler solely responsive to flow produced forces acting on said valve due to flow from said second cavity to said first cavity and due to flow from said first cavity to said second cavity, respectively.

2. A muffler comprising:

a housing;

a partition dividing said housing into a first and second cavity;

an inlet communicating with said first cavity and an outlet communicating with said second cavity;

a valve seat forming a portion of said inlet;

muffler tubes supported by said partition and providing fluid communication between said first and second cavities;

a valve having a first side facing and adapted to seat on said valve seat and a second side facing said partition;

said muffler tubes are arranged in an arcuate pattern over a portion of a circle and said outlet is circumferentially spaced from said portion of a circle;

said valve has a circular periphery portion which is radially inward of said muffler tubes and only tokenly overlies said muffler tubes;

said valve being movable between a first position seated on said valve seat and a second position permitting flow through said muffler solely responsive to flow produced forces acting on said valve due to flow through said inlet into said first cavity.

3. A muffler comprising:

a housing:

a partition dividing said housing into a first and second cavity;

an inlet communicating with said first cavity and an outlet communicating with said second cavity:

a valve seat forming a portion of said inlet;

muffler tubes supported by said partition and providing fluid communication between said first and second cavities;

a valve having a first side facing and adapted to seat on said valve seat and a second side facing said partition;

a valve guide stem extends through said partition;

said valve is slideable on said valve guide stem;

said valve being movable between a first position seated on said valve seat and a second position permitting flow through said muffler solely responsive to flow produced forces acting on said valve due to flow through said inlet into said first cavity.

4. A muffler comprising:

a housing;

a partition dividing said housing into a first and second cavity;

an inlet communicating with said first cavity and an outlet communicating with said second cavity;

a valve seat forming a portion of said inlet;

muffler tubes supported by said partition and providing fluid communication between said first and second cavities;

a valve having a first side facing and adapted to seat on said valve seat and a second side facing said partition;

a region located in said first cavity facing said second side of said valve;

a pressure equalization tube extends from said second cavity to said region facing said second side of said valve whereby said second side of said valve is at a pressure corresponding to that of said second cavity;

said valve being movable between a first position seated on said valve seat and a second position permitting flow through said muffler solely responsive to flow produced forces acting on said valve due to flow through said inlet into said first cavity.

* * * * *